US005885420A

United States Patent [19]

Heinzmann et al.

[11] Patent Number: 5,885,420

[45] Date of Patent: Mar. 23, 1999

[54] HEADBOX FOR PAPERMAKING MACHINE WITH MORE UNIFORM FLOW

[75] Inventors: Helmut Heinzmann, Bohmenkirch; Udo Heuser, Steinheim, both of Germany

[73] Assignee: J.M. Voith GmbH, Germany

[21] Appl. No.: 5,999

[22] Filed: Jan. 12, 1998

Related U.S. Application Data

[62] Division of Ser. No. 662,980, Jun. 13, 1996, Pat. No. 5,707,495, which is a continuation of Ser. No. 351,565, Dec. 7, 1994, abandoned, which is a continuation of Ser. No. 925,966, Aug. 5, 1992, abandoned, which is a continuation-in-part of Ser. No. 717,982, Jun. 20, 1991, abandoned.

[30] Foreign Application Priority Data

Jun. 20, 1990 [DE] Germany ..... 40 19 593.7

[51] Int. Cl.[6] ..... D21F 1/06

[52] U.S. Cl. ..... 162/198; 162/216; 162/258

[58] Field of Search ..... 162/198, 216, 162/336, 343, 258, 259

[56] References Cited

U.S. PATENT DOCUMENTS 4,888,094 12/1989 Weisshuhn et al. ..... 162/343

4,909,904 3/1990 Kinzler ..... 162/343

5,030,326 7/1991 Nous ..... 162/343

*Primary Examiner*—Karen M. Hastings

*Attorney, Agent, or Firm*—Ostrolenk, Faber, Gerb & Soffen, LLP

[57] ABSTRACT

A headbox for a papermaking machine with an outlet slot that distributes pulp suspension over the, working width of the papermaking machine. For controlling operating parameters of throughput, pulp density and fiber quality of the suspension over the width of the machine, the headbox has a plurality of individual sections across the width of the machine. Each section has respective channels therethrough for passing pulp suspension. At least one connection at each section is to a controllable supply of pulp suspension where the operating parameters of that supply are controllable. Only separate operating parameter controlled streams pass through the sections of the headbox. Operating parameter control devices may deliver adjusted streams to a mixer upstream of the headbox channels. The mixer may also have individual sections across the width of the machine. The headbox has a common outlet nozzle downstream of the individual channels and the individual sections, where the pulp suspension stream from channels with controlled suspension parameters and from any channels without controlled suspension parameters are reconstituted to have the desired suspension operating parameters.

5 Claims, 9 Drawing Sheets

32
FRC
24
$Q_H, C_H$
20
28
FR
38
36
FFC
MIXER
$Q_M, C_M$
22
FR
42
$Q_L, C_L$
34
26

44
FRC
24
$Q_H, C_H$
20
32
46
FRC
MIXER
$Q_M, C_M$
22
$Q_L, C_L$
35
26

A

Fig.3c
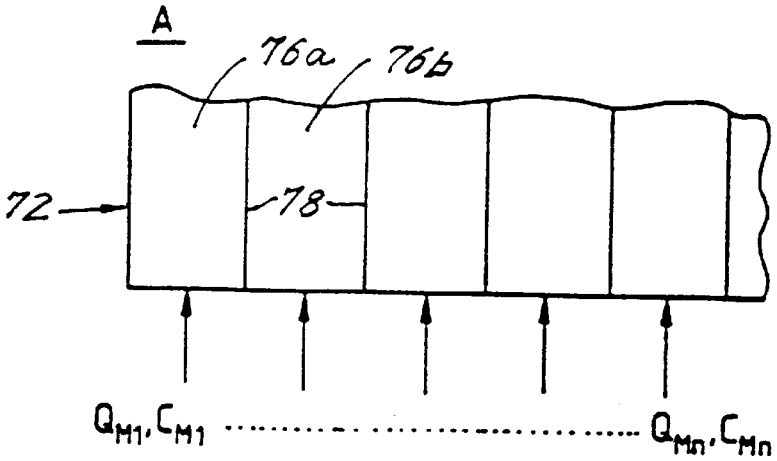
Fig.4a
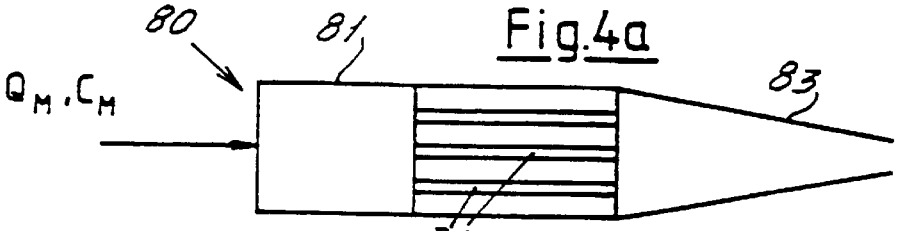
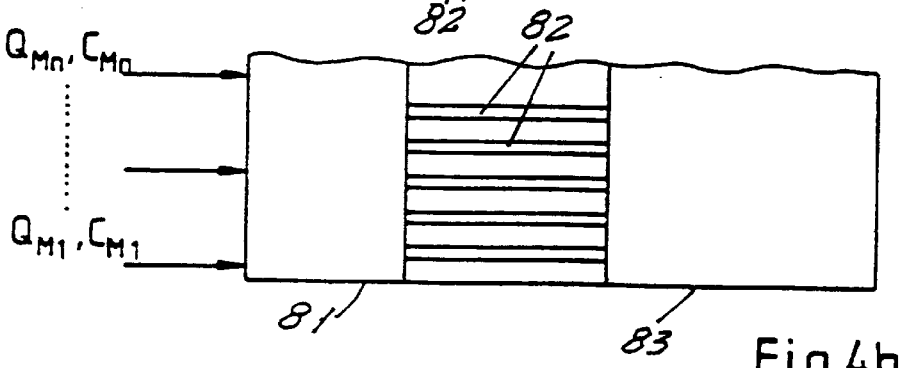
Fig.4b
Fig.4c
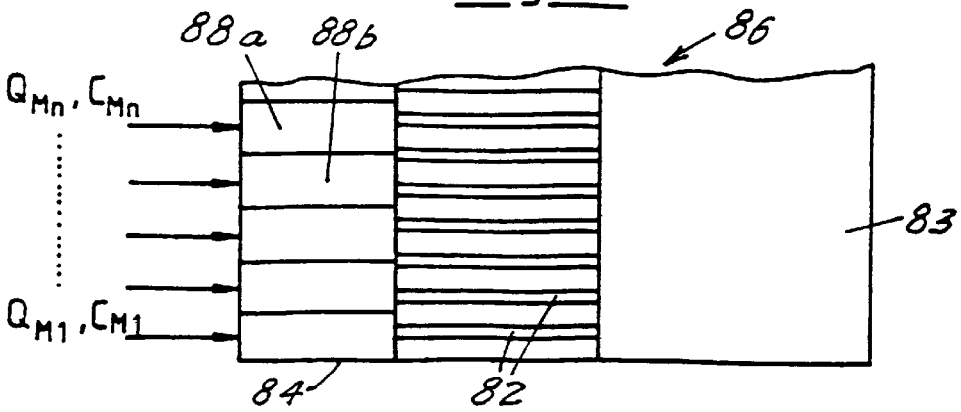

Fig.5a
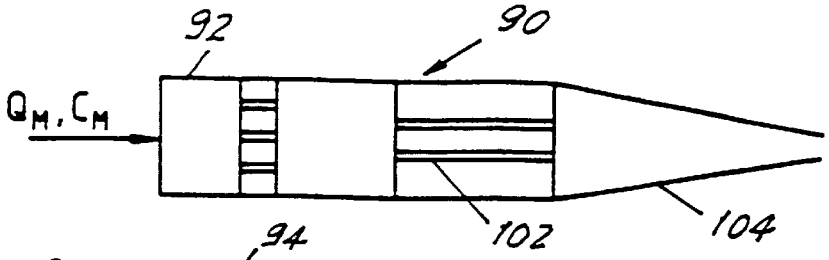
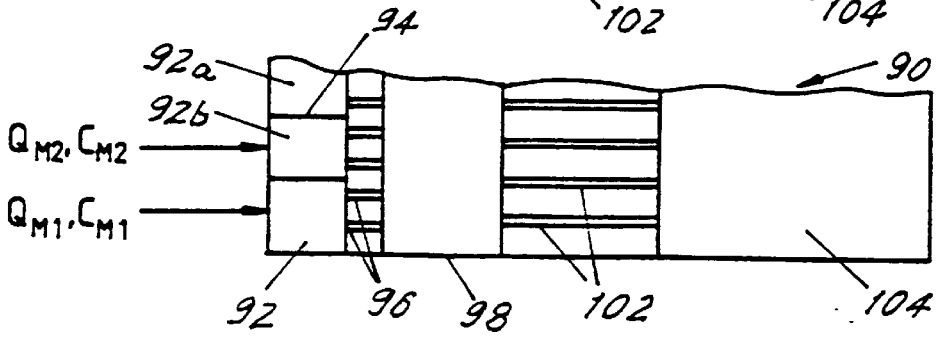
Fig.5b
Fig.6a
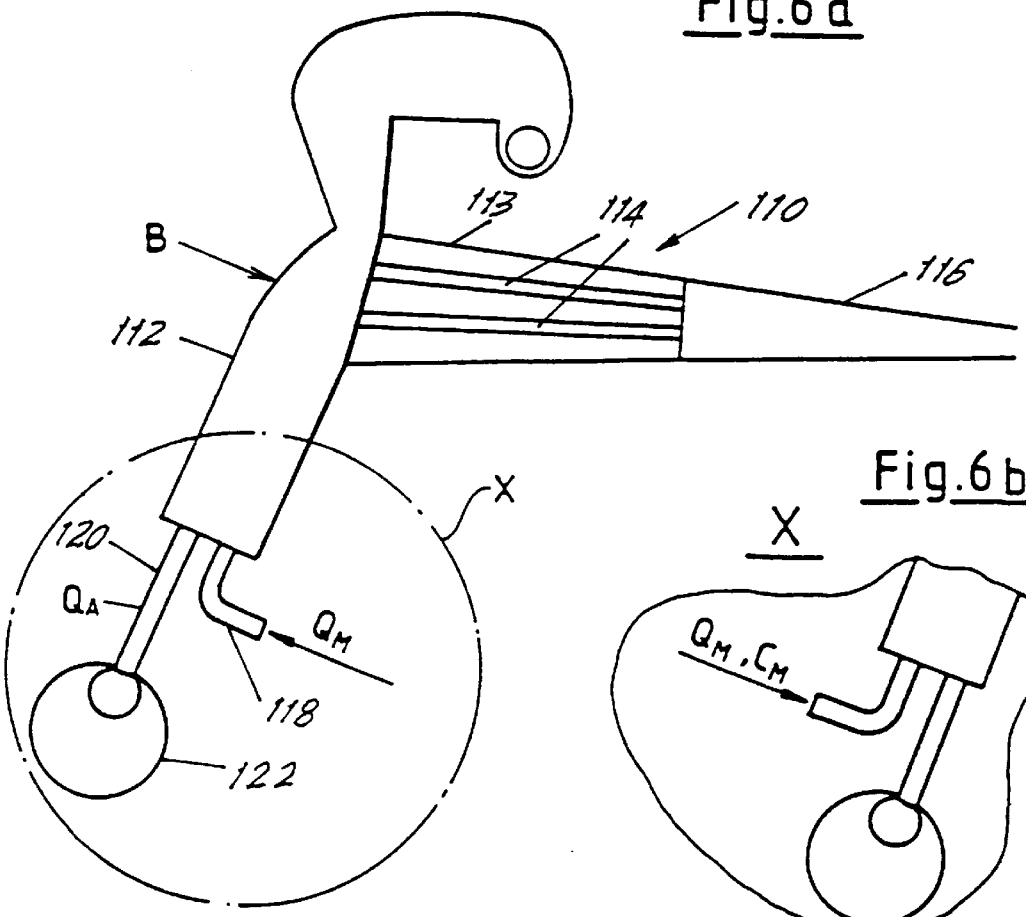
Fig.6b
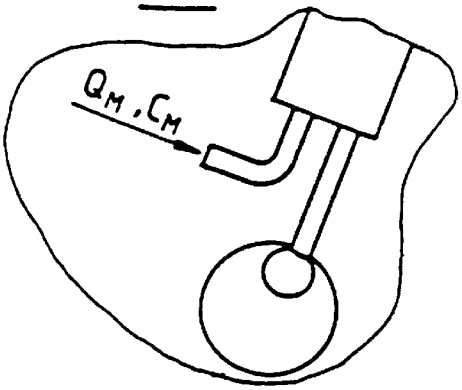

$Q_M, C_M$
164
160
167
170
C
166
162
174
169
168
C

C
164
166
$Q_{M1}$
$Q_{Mn}$
$C_{M1}$
$C_{Mn}$
169
174
168

306
304
300
302
FLOW

306'
304'
305
303
300'
302'
FLOW

306'
304'
305
303'
300'
300'a
302'
FLOW

306'
304'
305
303'
302'
300'
303''
307
FLOW

HEADBOX FOR PAPERMAKING MACHINE WITH MORE UNIFORM FLOW

REALTED APPLICATIONS

This is a Divisional of application Ser. No, 08/662,980, filed Jun. 13, 1996 now U.S. Pat. No. 5,707,495; which is a Continuation of 08/351,565, filed Dec. 7, 1994 now abandoned, which is a Continuation of 07/925,966, filed Aug. 5, 1992 now abandoned, which is a Continuation-in-Part of 07/717,982, filed Jun. 20, 1991 now abandoned.

BACKGROUND OF THE INVENTION

The present invention relates to a headbox or breastbox for a papermaking machine, and particularly to means for adjusting the pulp density or concentration of the pulp suspension over the working width of the headbox or the machine width. One such headbox is known from Federal Republic of Germany Patent 35 14 554 equivalent to U.S. Pat. No 4,88,094. Such a headbox is intended to make the pulp suspension uniform over the entire cross machine width of the pulp outlet from the headbox. At the downstream end of the flow path of the suspension, it should be made uniform in front of the discharge or outlet slot from the headbox. The uniformity sought is such that both the density of the pulp, that is, the weight of fiber content per unit volume, and the orientation of the fibers in the pulp, are constant over the width of the pulp outlet from the headbox. Both of these qualities are important prerequisites for the finished paper being produced by the papermaking machine, in order to have a proper weight per unit area profile over the entire cross machine width so called basis weight cross profile of the web and so that the paper lies flat and does not tend to curl.

During operation of the papermaking machine, numerous disturbing factors interfere with the satisfaction of the two uniformity requirements. These factors include temperature variations, pressure variations and manufacturing tolerances in the headbox and in the pulp suspension, for example.

The above noted German patent is concerned with solving the same problems as are noted above, which are also the problems to be solved by the present invention. That patent recognizes that it is important both to maintain the density of the fibers in the pulp suspension over the width of the pulp outlet and also to control the fiber orientation so that, if it is possible, no transverse flow will occur in the outlet channel. The German patent proposes that the density of the pulp suspension be changed locally, that is that the density of the pulp suspension be changed at given places across the machine width, as required. However, the patent does not provide what is believed by the present inventors to be the best solution to this problem.

It is also known to vary the width of the discharge slot, that is, the height of the outlet opening at the discharge slot. One way to do that is by the use of threaded spindles for swinging or bending one lip, and particularly, the upper lip that defines the discharge slot. For instance, see Federal Republic of Germany Patent 29 42 966, corresponding to U.S. Pat. No. 4,326,916, or Federal Republic of Germany Published Application OS 35 35 849. This adjustment of the width of the discharge slot enables local variation of the throughput of the suspension. At the same time, however, the direction of suspension flow is also locally affected, which affects the orientation of the fibers in the suspension. The local narrowing of the outlet slot causes a different flow direction in the fibers at the narrowed places of the slot than along the remainder of the discharge slot. Although the density of the pulp can be made uniform over the width of the pulp outlet by the so-called displacement control, the fiber orientation, which may have been good, is undesirably again disturbed. Although the inventors have recognized that the last two above noted German patent applications proceed fundamentally in the correct direction, nonetheless, they do not appear to be able to control independently the two parameters of the density of the pulp and the fiber orientation.

SUMMARY OF THE INVENTION

It is an object of the invention to provide a headbox or breastbox which enables independent control of each of the parameters of the basis weight cross profile suspension and the fiber orientation cross profile in the pulp suspension in a practical and reliable manner.

The concept of the invention involves sectionalizing the headbox into individual sections across the machine width, which is an already known design, and also to feed individually controllable, partial streams or section streams of the pulp suspension to the individual sections of the headbox. The operating parameters of each individual one of the partial streams, particularly their throughput, pulp density and fiber quality, can be individually adjusted without adjusting any of the parameters of the other partial streams or along with adjusting those parameters in the other partial streams differently. Each of the section streams feeds a respective separate section of the headbox. Each of the section streams is preferably conducted separately through the headbox, and the streams are combined with each other only toward the outlet nozzle from the headbox.

Each section stream is formed by bringing together two separate streams for that section, of which at least one stream, in some embodiments, and in other embodiments, both streams, have their above noted parameters controlled. Depending upon the mixture ratio, pulp concentration and the flow rate of these control streams, the nature of each of the section streams in each individual section can be very precisely established.

The headbox of the present invention distributes pulp suspension over the working width of the papermaking machine and ejects the suspension into the inlet slot or nip of a web forming section, for example.

The headbox includes a pulp suspension guide device through which pass a plurality of holes or channels that define the channels and that extend from the upstream to the downstream sides of the headbox. The holes or channels are in a selected array across the width of the headbox. There is a discharge nozzle also extending across the width of the machine with a discharge or outlet slot for distributing the pulp suspension. The discharge nozzle is shaped such that mixing of the pulp suspension from the respective channels of the pulp suspension guide is prevented.

Upstream of the headbox in the pulp suspension flow path are located means for adjusting the pulp density of the pulp suspension over the working width of the machine. The individual sections of the headbox are formed by partitions which divide the headbox into individual separate sections over the cross machine width. Each individual section has at least one feed line channel or hole for feeding through it a partial stream or section stream of the pulp suspension.

A mixer is arranged upstream of or in front of the feed line of the headbox. In one embodiment, the mixer has at least two connections for introducing respective parameter controlled suspension streams, having predetermined operating parameters, such as throughput, pulp density and fiber quality. In other embodiments, fewer than or only one of the connections and its suspension stream is controlled. But through merely that control, the final mixed output from the discharge slot is controlled.

Other objects and features of the present invention will become apparent form the following description of preferred embodiments of the invention considered in connection with the accompanying drawings.

BRIEF DESCRIPTION OF THE DRAWINGS

FIG. 3*c* is a view in the same direction as FIG. 3*b*, showing a partitioned common section embodiment for individual deliveries of mixed suspension to the suspension guide;

FIG. 4*a* is a side elevational cross-sectional view through a third embodiment of a headbox, where the individual sections are narrowed channels through the headbox and there are a plurality of those channels in each section, which are arrayed vertically across the headbox;

FIG. 4*b* is a plan cross-sectional partial view of the headbox of FIG. 4*a;*

FIG. 4*c* is an alternate fourth embodiment of the headbox of FIG. 4*b*, wherein the common section has individual partitioned sections, each for transmitting to the suspension guide a respective mixture of pulp suspension;

FIG. 5*a* is a side elevational cross-sectional view of a fifth embodiment of a headbox and mixer, showing two longitudinally spaced areas of partial channel sections in the headbox;

FIG. 5*b* is a plan cross-sectional view of the headbox of FIG. 5*a*, showing the individual sections of the common section across the width of the headbox;

FIG. 6*a* is a side elevational cross-sectional view of a sixth embodiment of a headbox and mixer combination, wherein the mixer is fed with a premixed partial stream which is mixed with a conventional supply of pulp suspension;

FIG. 6*b* is an enlarged detail of FIG. 6*a;*

FIG. 10*a* is a side elevational cross-sectional view of an alternate, tenth embodiment of a headbox with direct feed of a controlled mixture partial stream into one or more of the tube lines;

DESCRIPTION OF THE PREFERRED EMBODIMENTS

Figure 1A:
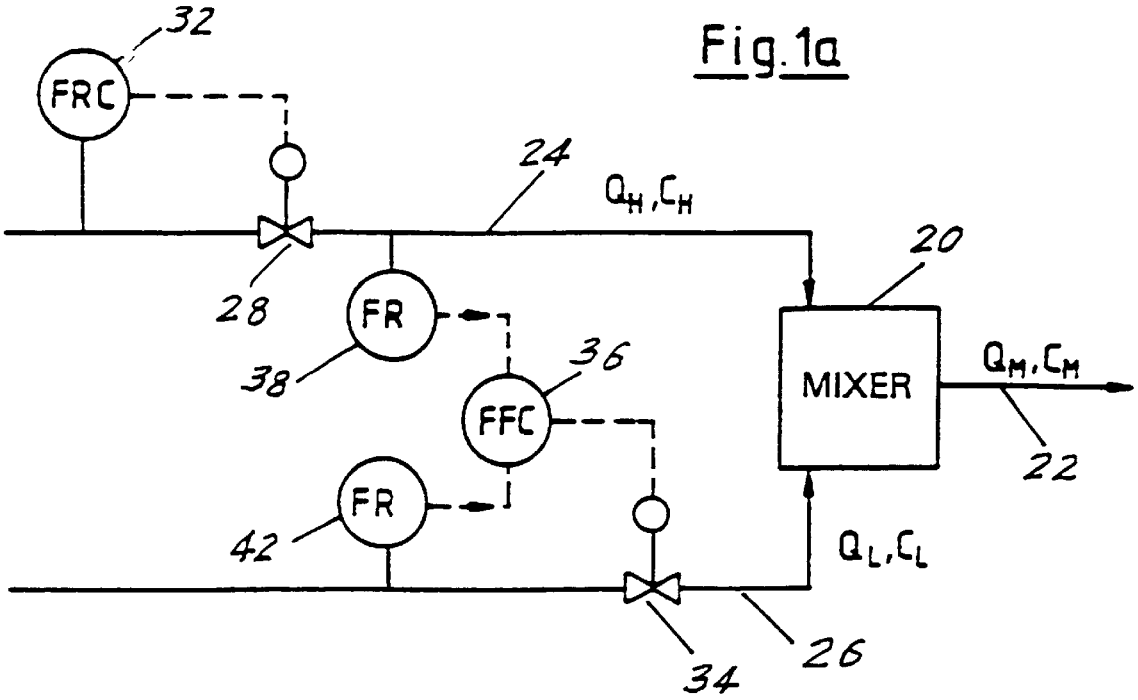
FIG. 1*a* schematically illustrates one pulp suspension control apparatus, and shows means for mixing flows that are supplied to individual sections of the headbox.

In the pulp suspension control apparatus shown in FIG. 1*a*, the mixer 20 delivers to the headbox, not shown in FIG. 1*a*, a mixed stream 22 having the volume $Q_M$ and having the concentration $C_M$ of fiber material in the pulp suspension.

The mixer 20 is supplied by two separate pulp suspension streams which are brought together in the mixer. The first stream 24 has the volume $Q_H$ and the fiber concentration $C_H$. The second stream 26 has the volume $Q_L$ and the fiber concentration $C_L$. The first pulp stream 24 is supplied from a source, not shown, past the volumetric control, adjustable valve 28 that is controlled by flow rate controller 32. The second pulp stream 26 is supplied from another source not shown, and is controlled by an adjustable valve 34. The valve 34 is controlled by the flow ratio controller 36. That controller 36 is supplied by the two flow rate measurement devices 38 and 42 which measure the flows of streams 24 and 26. Adjustment of the volume ratios $Q_H/Q_L$ will be determined by the flow ratio controller 36 and the valve 34. The total flow rate of suspension flow 22 is controlled by the flow rate controller 32 and the valve 28 in addition to the flow ratio controller 36 and the valve 34.

An actual situation controlled by the control apparatus of FIG. 1*a* is now described. The arrangement shown in FIG. 1*a* delivers a pulp suspension flow to a conduit 22 which is connected to one of the individual sections of a headbox. As will be apparent below, there may be an individual one of the control apparatus shown in FIG. 1*a* for each of the individual sections of the headbox across the machine width, and each of those individual control apparatus shown in FIG. 1*a* can be operated independently.

During a periodic quality control check of the paper web being produced or of the pulp suspension being dispensed by the headbox, it may be found that the weight per unit area profile basis weight, at the individual section across the width of the web, of the mixed pulp suspension which is supplied through mixer 20 in FIG. 1*a* and controlled by the control devices shown in FIG. 1*a*, differs beyond an acceptable level from a desired value, either in flow volume $Q_M$ or pulp suspension concentration $C_M$.

Therefore, the pulp density of the suspension in the headbox must be suitably corrected at this section across the width of the headbox.

According to the invention, the adjustment can be made by varying the concentration $C_M$ of the individual section stream 22 that is controlled by the control apparatus shown in FIG. 1*a*. The necessary change in $C_M$, that is $dC_M$, can be determined from a previously prepared weight balance sheet. The resulting corrected concentration $C_M$ is dependent exclusively upon the ratio of the control streams $Q_H/Q_L$. The total flow through 22 of these two streams 24 and 26 may be halted while the ratio adjustment is made. The corrected value of the basis weight is used as a basis for ratio control to establish the desired value setting. The ratio control sets the new flow ratio $Q_H/Q^L$. In FIG. 1*a* this is accomplished by changing $Q_L$, e.g. through valve 34. However, it is important that the combined volumetric flow $Q_M$ remain constant, so that the individual headbox section may be fed with a correct constant volume. Therefore, to correct the volume and concentration, the control volume stream QH is corrected in accordance with a production continuity equation which had previously been prepared. This control is carried out using the apparatus shown in FIG. 1*a*. For this purpose, the change in the desired value of the control volume streams must be calculated from new basis weight $C_M$ and must then be fed to the controllers effective for bringing this about at 28, 34, and 36. Various types of flow controllers for delivery of pulp suspension at the correct concentration may be used, as is known to one skilled in the art.

Transverse flows of the suspension can take place within the headbox and in the headbox spray nozzle. These could result, for example, due to edge influences in the headbox. This can lead to an undesired effect on the orientation of the fibers in the suspension. In known headboxes, this occurs because of the presence of different volumetric streams over the cross machine width of the headbox.

Due to the flow control apparatus of FIG. 1*a*, the concentration of fibers in the suspension $C_M$ remains constant. The calculated required volumetric stream of $Q_H$ is fed as a desired value to the controllers. This adjusts the two streams until the desired volume $Q_M$ and concentration $C_M$ are present in the stream 22.

Figure 1B:
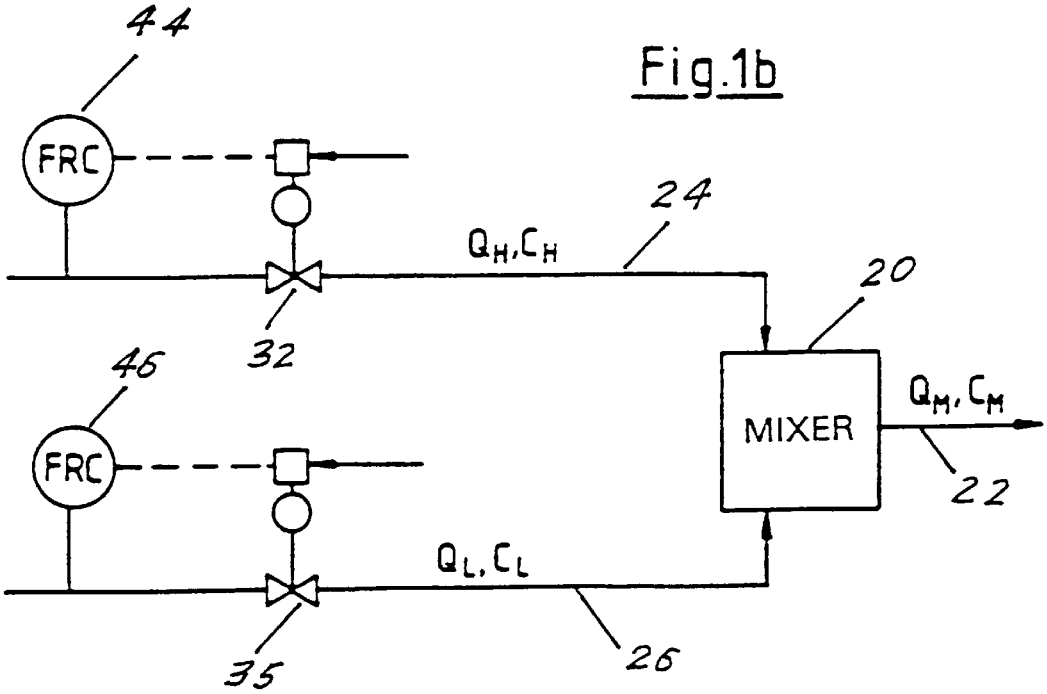
FIG. 1*b* illustrates an alternate pulp suspension control apparatus.

In accordance with the alternate control apparatus shown in FIG. 1*b*, the same types of operations take place and similar elements are present, except that both of the streams QH and QL are controlled by the adjustable valves 32 and 35 which correspond in function to the valves 28 and 34. The other elements in FIG. 1*b* which correspond to those in FIG. 1*a* are similarly numbered. In the apparatus of FIG. 1*b*, two calculated volumetric streams $Q_H$ and $Q_L$ must be fed as new desired values to the controllers.

The present invention may be applied to various types of headboxes, including single layer headboxes, multiple layer headboxes, headboxes for slit formers, paper wires, with and without vibration dampers, having one or two tube bundles, etc.

Various headbox embodiments are shown in FIGS. 2–11 and are now briefly described.

Figure 2A:
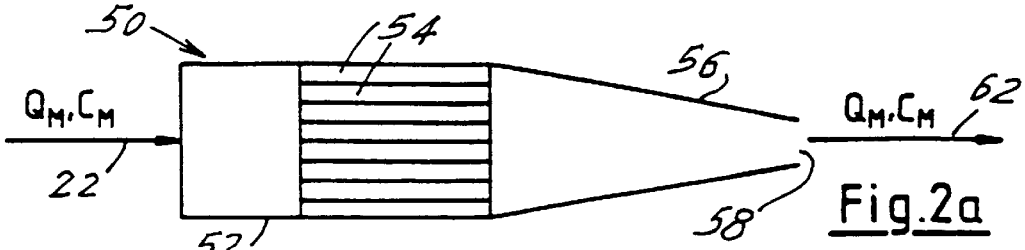
FIG. 2*a* is a side elevational cross-sectional view through one individual section of a first embodiment of a headbox, with a plurality of individual pulp flow channels through it.
Figure 2B:
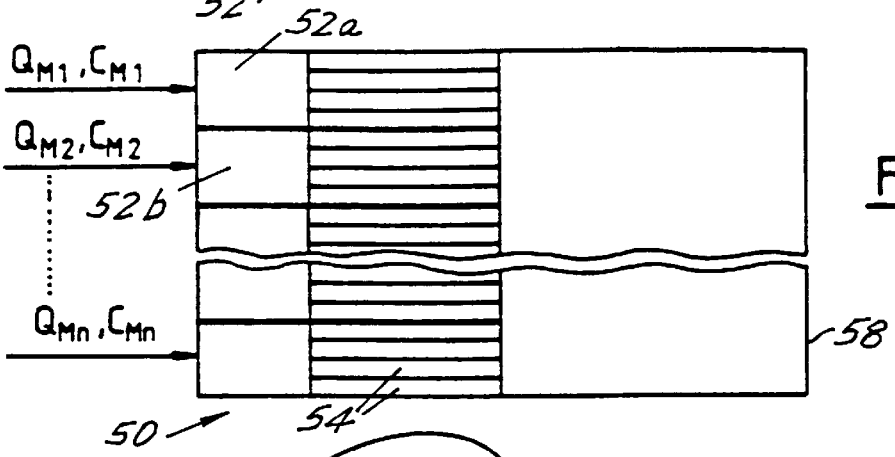
FIG. 2*b* is a plan cross-sectional view of the headbox of FIG. 2*a* showing individual headbox sections and showing a plurality of channels through the headbox arrayed across the width of the machine and in each of the individual headbox sections.

FIGS. 2*a* and 2*b* illustrate a headbox having individual mixed suspension streams 22 at $Q_M$, $C_M$ delivered to the headbox. In FIG. 2*a*, the headbox has an entrance section 52 from the mixer (not shown here), individual section channels 54 in a vertical stack, which are defined by partitions between them, and a tapering outlet nozzle 56 leading to the outlet slot 58 from which the stream 62, still at total volume $Q_M$ and concentration $C_M$, is sprayed into an inlet nip, onto a wire former, etc., in the usual manner for headboxes.

FIG. 2*b* shows that there are individual streams $Q_M$, $C_M$ across the width of the machine. Each stream may be supplied by a separate control arrangement as in FIG. 1*a* or FIG. 1*b*. The headbox entrance section is divided into individual sections 52*a*, 52*b*, etc., across the width of the machine. Each of the entrance sections is an inlet which feeds a respective plurality of individual channels 54, which, as can be seen from both of FIGS. 2*a* and 2*b*, are arrayed in rows and columns within the headbox. There is a single combined outlet nozzle 56 through which the various flows from the channels 54 combine and then exit the headbox. It is apparent that control over the individual volumes $Q_M$ and concentrations of pulp or fiber $C_M$ will control the respective flows through the individual partitioned entrance sections 52*a*, 52*b*, 52*c*, for providing a desired profile of flow volume and concentration across the width.

As will be apparent to those of skill in the art, the connections between the mixers supplying the pulp stream $Q_M$ $C_M$ and the entrance sections 52 can also be in the form of separate pipes, tubes or hoses, either rigid or flexible, and disposed at any angle or in any configuration. In such an embodiment, the sections 52 could be used or they could be dispensed with. In addition, valves can be disposed at the output of certain ones or all of the mixers in the lines between the mixers and the entrance sections 52. This is the case for each of the embodiments described herein.

Figure 3A:
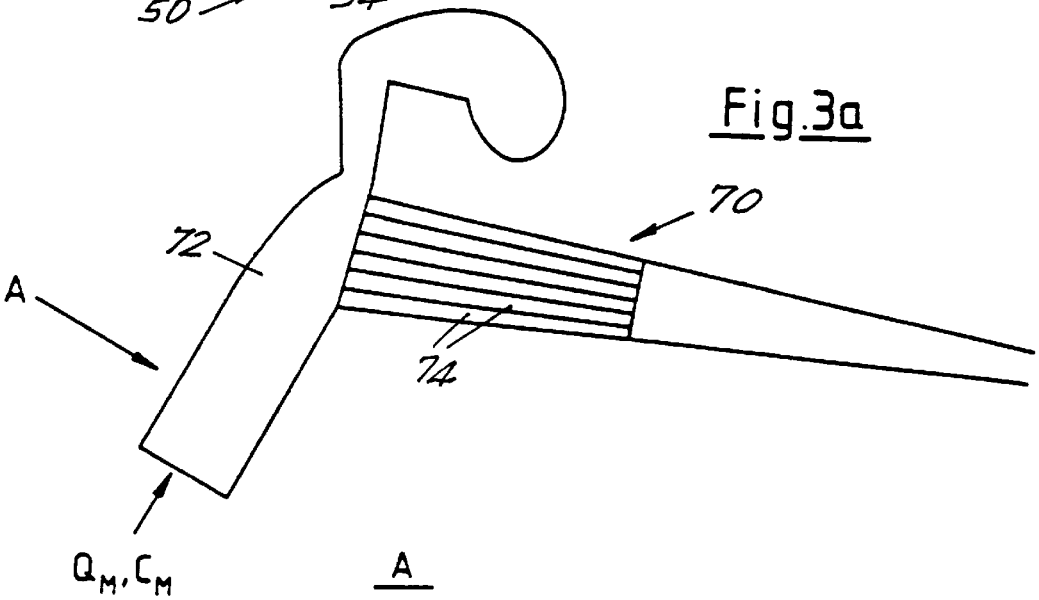
FIG. 3*a* illustrates a second headbox embodiment like that in FIG. 2*a* and 2*b* and schematically depicts the suspension flow from the mixer which delivers parameter controlled suspension to the common section of the headbox.
Figure 3B:
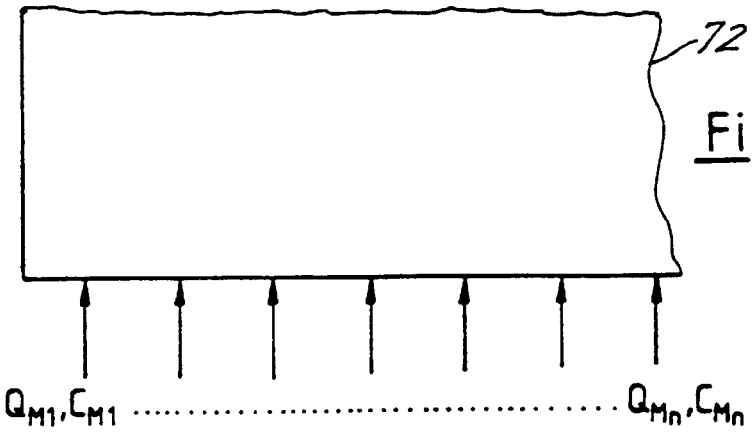
FIG. 3*b* is an end view of the common section of FIG. 3*a*, seen in the direction of arrow A in FIG. 3*a*, showing individual deliveries of mixed suspension to the mixer for subsequent delivery to the headbox.

FIGS. 3*a*, 3*b* and 3*c* show a headbox 70 with a plurality partitioned sections 74 which are separated by individual partitions and supplied by an entrance section 72.

As can be seen in FIG. 3*b*, the entrance section 72 itself might not have individual sections, but its partitioned design would permit some mixing of the suspension passing through the entrance section before it reaches the partitioned sections 54 of the headbox. In FIG. 3*c*, in contrast, the entrance section 72 also has individual sections 76*a*, 76*b*, etc., each corresponding to and for delivering suspension to respective partitioned sections 74 of the headbox.

FIGS. 4*a* and 4*b* show an alternate headbox design 80 from that shown in FIGS. 2 and 3, wherein there is a unitary and not individually sectioned entrance section 81 to the headbox, followed by individual separated channels or tubes 82 through the headbox which are arrayed in vertically spaced apart stacks and horizontally spaced apart columns. This provides partitioned sections across both the height and the width of the headbox. Each section across the width of the headbox is supplied generally from its own respective adjusted suspension stream $Q_M$, $C_M$. There is an outlet nozzle 83 from the headbox where the various flows through the channels 87 are recombined.

FIG. 4*c* differs from FIG. 4*b* only in that the entrance section 84 of the headbox 86 itself has individual vertical partitions dividing the entrance section 84 into individual sections 88*a*, 88*b*, etc., corresponding to one or more of the individual channels 82. Some of the individual sections 88 may supply more than one of the individual channels 82, as suggested in FIG. 4*c*.

FIGS. 5*a* and 5*b* show an alternate headbox 90 which has an entrance section 92 with panels 94 that separate the entrance section into separate sections 92*a*, 92*b*, etc. Downstream of the sections 92*a* are narrowed channels 96, which in turn lead into a common transmitting chamber 98 and that leads to the individual section channels 102 which correspond in function and placement to the channels shown in FIG. 4*a*. Following the channels 102 downstream is the outlet nozzle 104. The individual channels 96 are more frequent than the downstream channels 102.

Figure 6C:
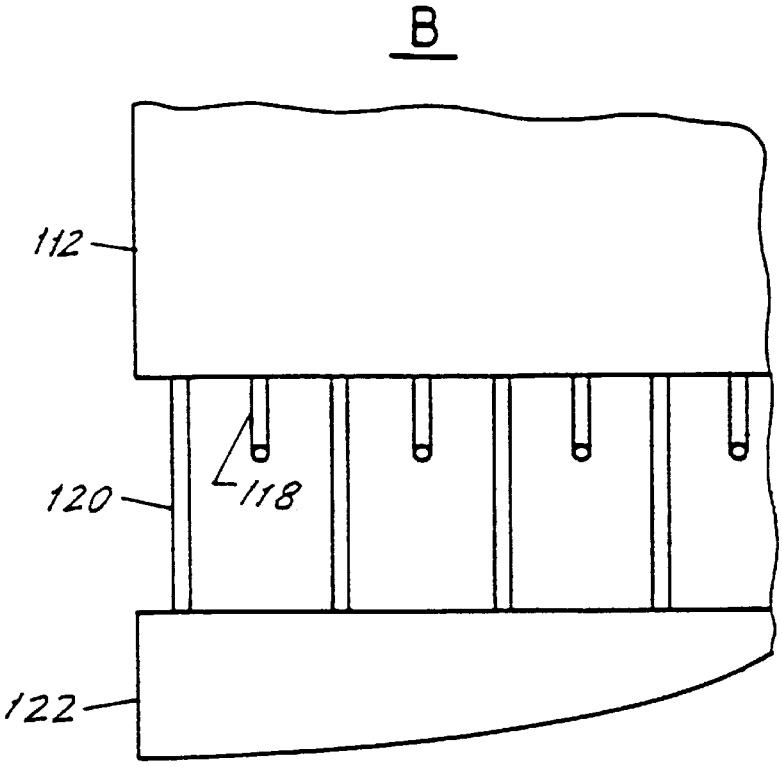
FIG. 6*c* is a rear view of the mixer of FIG. 6*a*, showing the suspension or material feed to the mixer.

FIGS. 6*a*, 6*b* and 6*c* illustrate a headbox 110 and a common section 112 which cooperate. The headbox includes a plurality of individual cross machine sections 113, as in previous embodiments. Each section has at least one column and more likely a plurality of vertically arrayed columns of tubes or channels 114. An outlet nozzle 116 follows all of the channels 114 downstream. The common section 112 is at and delivers suspension streams $Q_A+Q_M$ to the inlet ends of the passages 114 in the headbox.

FIGS. 6*a* and 6*b* show inlet through the first inlet passage 118 of only part of the total flow to the common section from a control apparatus as in FIG. 1*a* or 1*b*. A separate stream is delivered to the mixer through the passageway 120 from a conventional source 122. Therefore the common section 112 combines the streams $Q_M$ and $Q_A$. FIG. 6*c* shows the common section 112 as not having partitions dividing it in the cross machine direction. But the common section 112 could additionally be supplied with partitions like the common section 72 in FIG. 3*c*.

Figure 7:
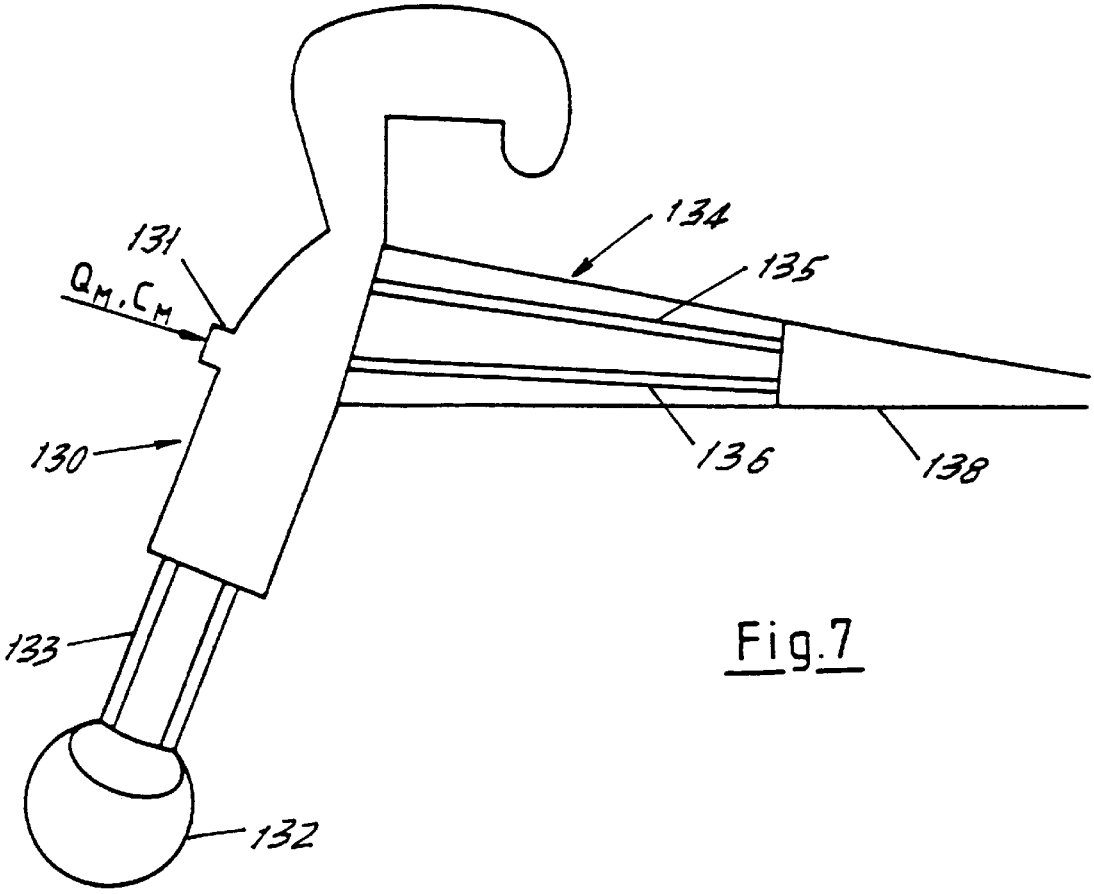
FIG. 7 is a side elevational cross-sectional view of a seventh embodiment of a headbox and mixer combination where the mixed partial streams are fed into a channel between the tube bundles through the headbox.

FIG. 7 shows the feeding of the adjusted quantity and concentration mixture $Q_M$, $C_M$ into the common section 130 through the inlet port 131. Just as in the embodiment of FIGS. 6*a*, 6*b* and 6*c*, the partial stream $Q_M$, $C_M$ is only part of the liquid supplied to the headbox. A conventional stream of pulp suspension or liquid is delivered to the mixer 130 from the conventional suspension source 132 through the passages 133.

Then the common section delivers the combined suspension to the headbox 134 which has separated upper and lower tube bundles or channels 135, 136 which in turn deliver suspension streams to be mixed in the nozzle 138. The feeding of the partial stream $Q_M$, $C_M$ is into a channel between the tube bundles 135, 136, and the tube bundles may, for example, be defined by appropriate perforated plates.

Figure 8A:
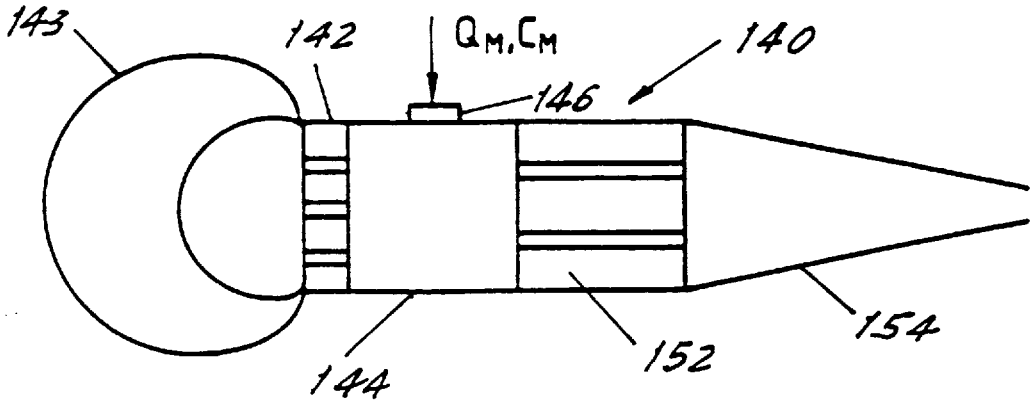
FIG. 8*a* is a top view of an eighth embodiment of a mixer and headbox combination wherein the plurality of parameter controlled partial streams are fed to connections across the top of the headbox past the introduction mixer.
Figure 8B:
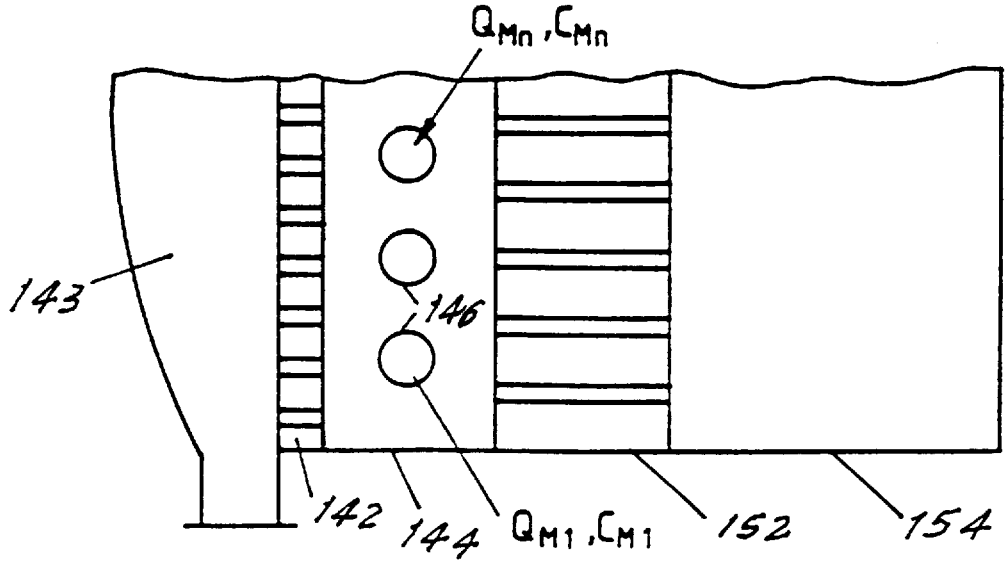
FIG. 8*b* is a top view of the headbox and mixer combination of FIG. 8*a;*

FIGS. 8*a* and 8*b* show another common section and headbox arrangement. The headbox 140 has the separate section inlet part 142 which receives only a first liquid stream, e.g., a first controlled adjusted stream or a conventional pulp suspension stream. This is supplied across the width and height of the headbox by the distributor 143. Downstream of the inlet part 142 is a common entrance section 144 into and across the top of which all of the individually adjusted volume and concentration flows $Q_M$, $C_M$ from apparatus as in FIGS. 1*a* or 1*b* are introduced through respective ports 146 arrayed across the machine width. The section 144 is followed by the individual channels or tubes, which define the headbox sections 152. That is followed by the nozzle 154, as in the other embodiments.

Figure 9A:
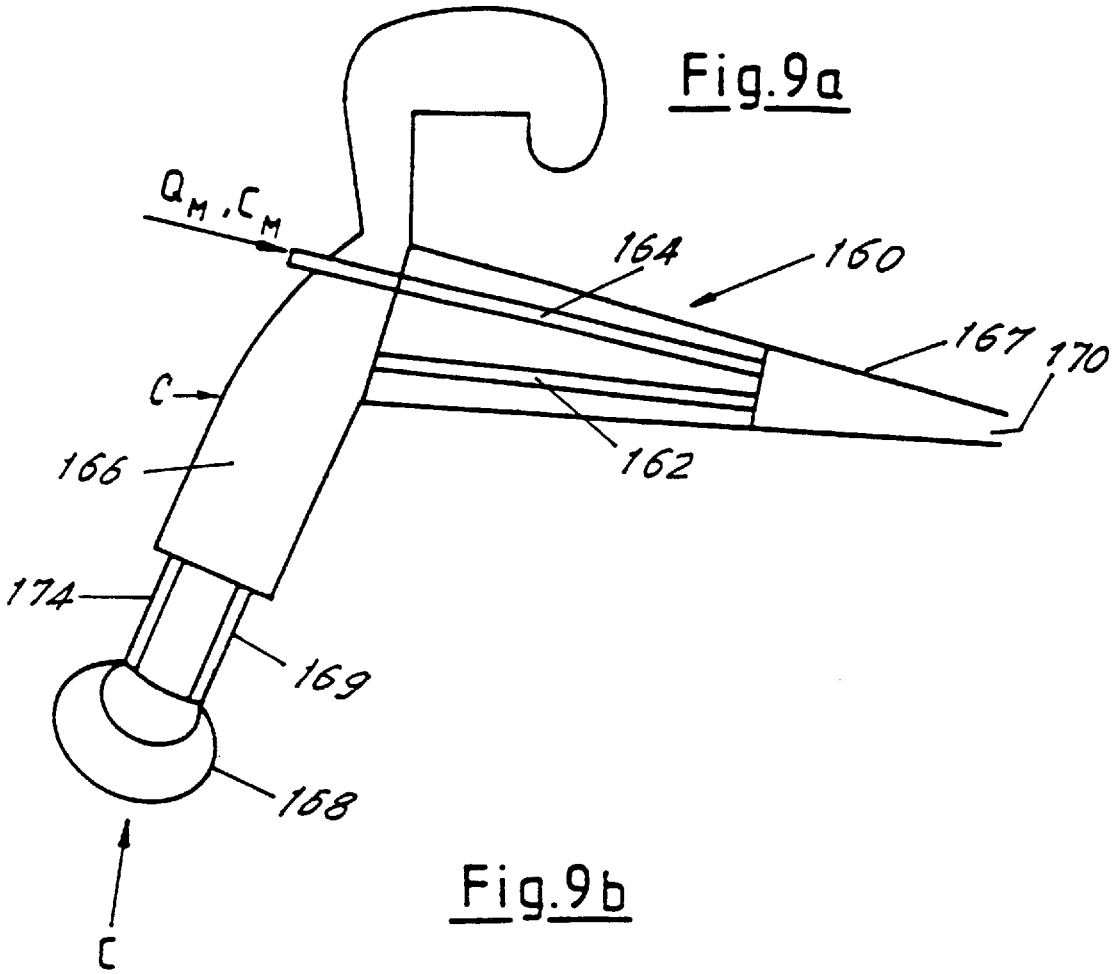
FIG. 9*a* is a side elevational cross-sectional view of a ninth embodiment of a combination of headbox and mixer showing direct feeding of the connections across controlled partial streams into one or more of the tube lines of the turbulence inserts of a section of the headbox.
Figure 9B:
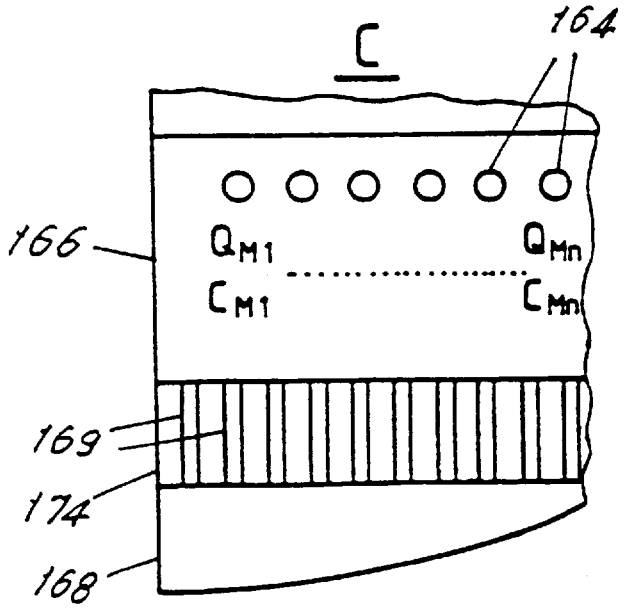
FIG. 9*b* is rear view of the headbox of FIG. 9*a* in the direction of arrow C in FIG. 9*a;*

FIGS. 9*a* and 9*b*, show an alternate arrangement with a headbox 160 having individual channels or tube bundles 162, 164 above one another. A common section 166 delivers pulp suspension from a conventional source 168 through passages 169. The controlled volume and concentration flow $Q_M$, $C_M$ is directly fed into the section channels or tubes 164 without also being fed into the channels or tubes 162, while the conventional flow is fed into the tubes 162, but not into the tubes 164. The two flows are therefore separated in their passage through the individual sections of the headbox, but the flows are joined in the nozzle 167 and they exit combined together through the nozzle outlet 170. From FIG. 9*b*, it can be seen that the common conventional source 168 feeds liquid not in a common flow but rather in long individual separated tubes 169 across the width of and through the intermediate section 174 and into the top part of the common section 166 before that liquid is delivered distributed across the headbox to the tubes 162.

Figure 10B:
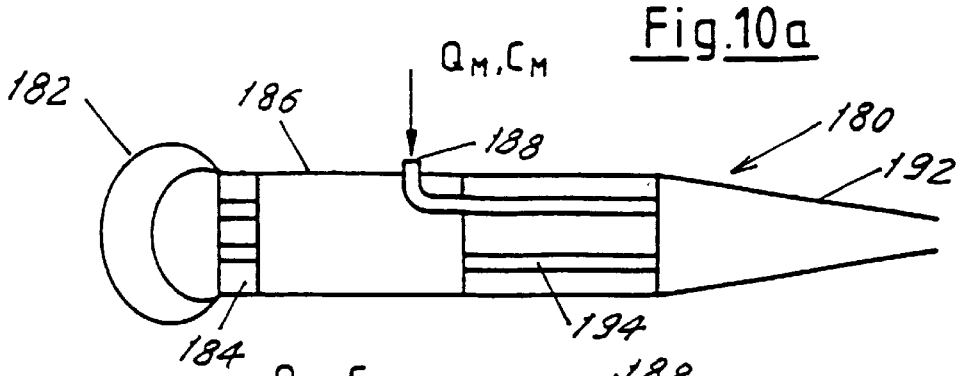
FIG. 10*b* is a plan longitudinal cross section of the headbox and mixer of FIG. 10*a;*
Figure 10B:
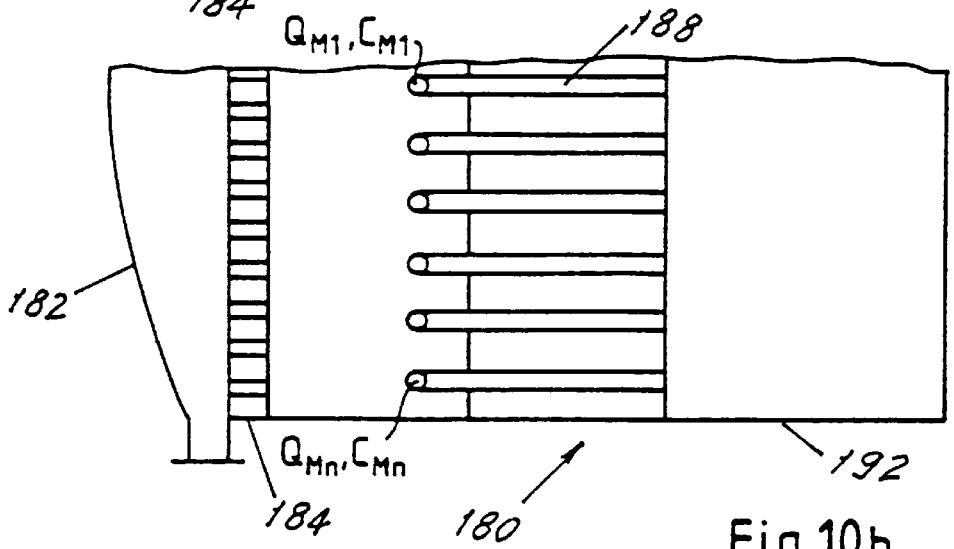

FIGS. 10*a* and 10*b* show an alternate headbox design 180 with a supply of suspension by a conventional supply 182 at its entrance through the tube section 184 and into the common section 186. The liquid suspension at controlled volume and concentration $Q_M$, $C_M$ is fed through the tubes or channels 188 into the nozzle 192. The conventional liquid leaves the common section 186 and passes through the tubes 194. The separated flow through the tubes 188 and 194 is combined together in the nozzle 192, like in the embodiment of FIGS. 9*a* and 9*b*.

Figure 11A:
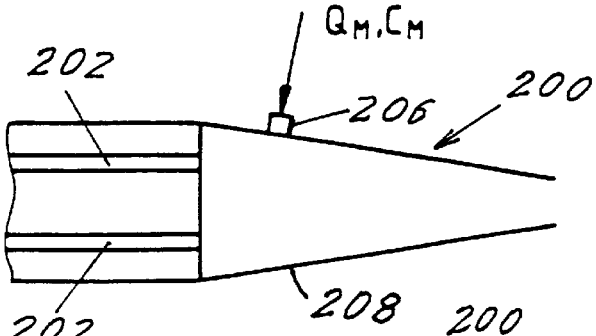
FIG. 11*a* is a side elevational cross-sectional, fragmentary, view of an eleventh embodiment of a headbox showing feeding of the parameter controlled mixture into the nozzle space downstream of the individual sections.
Figure 11B:
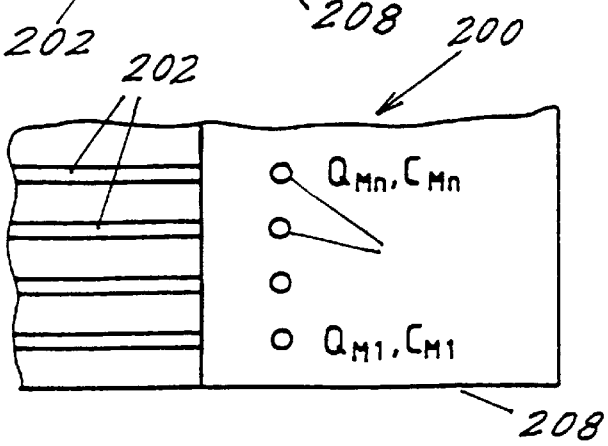
FIG. 11*b* is a top view of the headbox of FIG. 11*a*.

Finally, FIGS. 11*a* and 11*b* show a headbox 200 having a separated flow, in individual sections in the form of 202 of conventional pulp suspension. The controlled flow $Q_M$, $C_M$ for the individual sections is delivered through the entrance conduits 206 arrayed across the machine width in the outlet and combining nozzle 208, which is downstream from the individual sections 202 through which the conventional suspension travels. The distribution of the individual entrance ports 206 across the width provides the individual sections of the headbox with needed flow and concentration adjustment.

In all cases, the flow which has been adjusted across the width of the headbox is reconstituted as a single flow with corrected concentration and flow rate in the downstream nozzle before it exits through the discharge outlet.

Figures 12A, 12B, 12C, 12D:
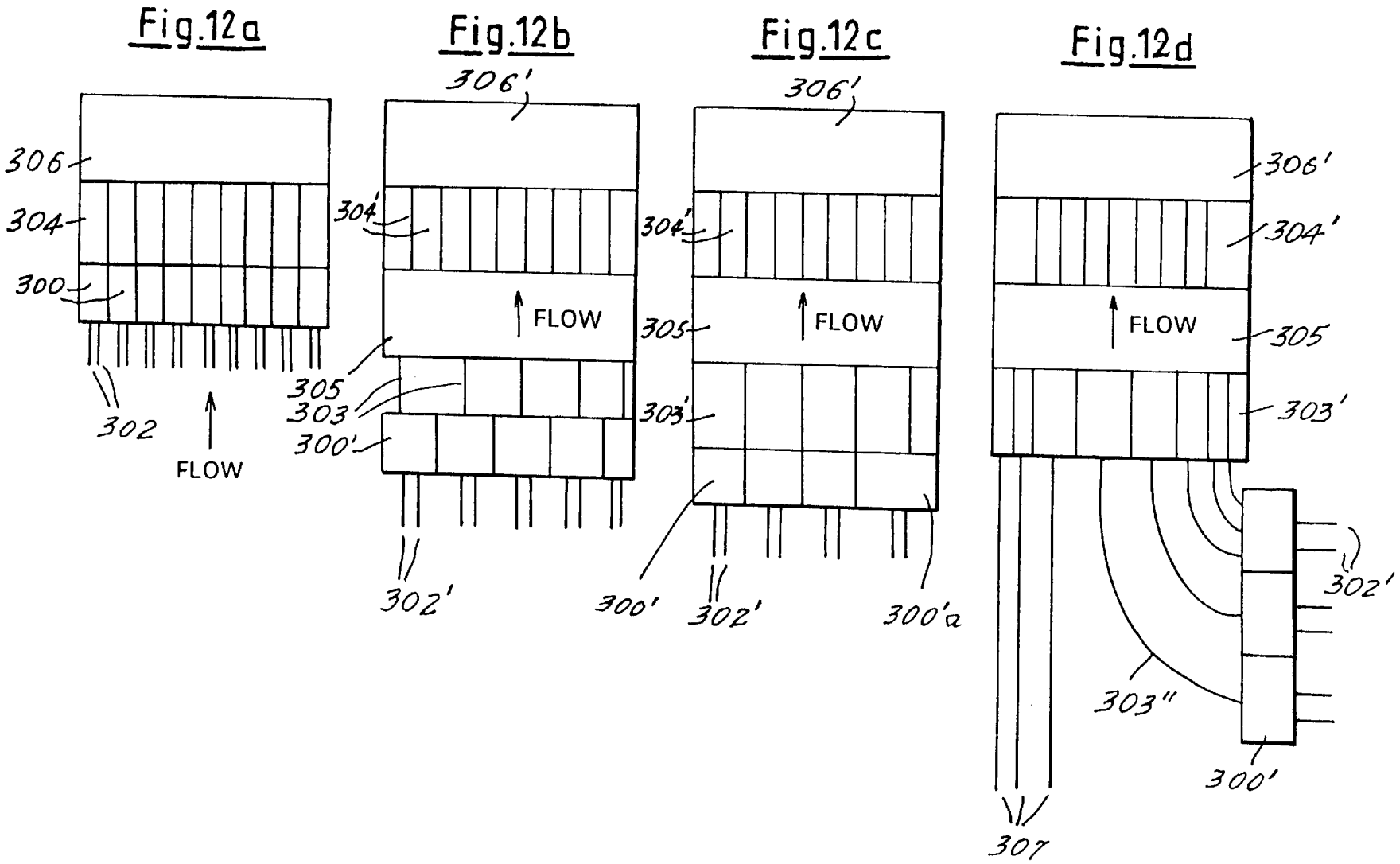
FIGS. 12*a*–12*d* show other embodiments of the headbox and mixer arrangement according to the present invention in schematic fashion.

FIGS. 12*a*–12*d* show other arrangements of the headbox or mixer according to the invention in a schematic fashion. In FIG. 12*a*, the mixers 300 are each supplied with partial streams 302. The output of each mixer 300 is supplied to a respective section 304 of the pulp suspension guide. The pulp suspension guide sections 304 are separated by a plurality of partitions into the separate sections 304. The pulp suspension guide output feeds into a common nozzle 306.

The pulp suspension guide can be divided into the plurality of sections 304 in various ways. For example, perforated plates can be used to achieve the plurality of sections, bunches of tubes or hoses can be used, horizontal or vertical plates or partitions, or flexible blades can be provided.

In FIG. 12*b*, a plurality of mixers 300' are provided, each of which is fed by two partial streams 302'. The output of each mixer 300' feeds into a line 303, which may, for example, comprise a tube, hose or pipe, or any other suitable channel. Each pipe 303 feeds into a common section 305, the output of which is fed to a plurality of sections 304' of the pulp suspension guide. The output of each section 304' is then fed to a common nozzle 306'.

In FIG. 12*c*, similarly, partial streams 302' feed mixers 300'. The outputs of the mixers then feed into a chamber 303', which is separated into a plurality of sections by partitions. The output of each section 303' feeds into a chamber 305, the output of which is provided to each of the sections 304' of the pulp suspension guide. The output of each section 304' is then fed to the common nozzle 306'. As shown in FIGS. 12*b* and 12*c*, the chambers 303' can have different widths across the machine, and similarly, the mixers 300' can have different widths across the machine, in accordance with the parameters of the pulp suspensions carried by the particular sections.

FIG. 12*c* illustrates that in addition to each mixer 300' feeding mixed pulp suspension to one chamber 303', a mixer 300'*a* may feed mixed pulp suspension to a group of two or three chambers 303', preferably, but not necessarily, arranged side by side, depending on requirements. As also shown in FIG. 12*c*, a plurality of mixers 300' may also feed mixed pulp suspension to only one chamber 303'*a*.

FIG. 12*d* shows an arrangement in which the mixers 300' are disposed so that they only feed certain of the chambers 303'. In addition, the mixers feed the chambers 303' through lines 303", which may comprise tubes, hoses or pipes, flexible or rigid, disposed at any angle or bent or shaped into any configuration. Partial streams 302' are fed to each mixer 300'. Certain of the chambers 303' are also fed by conventional unmixed streams 307. As shown in FIG. 12*d*, the chamber widths 303' may vary across the machine width. The outputs of the chambers 303' feed into a common chamber 305, which feeds into a plurality of sections 304' of the pulp suspension guide. As shown in FIG. 12*d*, the widths of the sections 304' of the pulp suspension guide also may vary across the machine width, depending on the parameters of the pulp suspensions carried by the particular sections.

As discussed, each of the partial streams feeding into the mixers may have different properties, e.g., concentration, type of fiber, etc., and these different properties are adjusted by suitable adjusting devices, as disclosed in FIGS. 1*a* and 1*b*. As shown in FIGS. 12*b, c* and *d*, the distances between neighboring partitions may be different within one chamber as well as in more than one chamber of the overall device. Furthermore, the distances may even change along the flow paths, so that although not shown in FIGS. 12*b, c* and *d*, the lengths of the chambers in the direction of pulp flow may change or may be different from other sections of the same chamber.

Additionally, the distances between the partitions may be changeable during operation in order to influence the pulp suspension qualities. Valves or other adjusting members may be disposed at any of the inlets and outlets of any of the mixers or chambers of the device.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for providing at least one of a selected basis weight cross profile and a selected fiber orientation cross profile over the width of a web of paper being manufactured in a paper making machine, wherein the machine includes a headbox having a plurality of separate suspension supply sections distributed along the width of the machine for supplying suspension for further processing into paper in the machine, and the machine further includes means following the headbox in the path of the suspension for processing the suspension to produce a paper web having a width along the width direction of the machine;

the method comprising:

supplying at least two partial streams to at least some of the sections of the headbox, wherein at least one of the partial streams to each of the headbox sections, that is being supplied by at least two partial streams, includes suspension, such that each section supplies a respective combined stream including suspension for further processing;

selectively controlling the volume per unit of time of at least one of the partial streams to each of the sections, that is being supplied by at least two partial streams, and also selectively controlling the volume per unit time of the combined stream from at least one of the sections that is being supplied by at least two partial streams for either varying the basis weight cross profile of the web without affecting the fiber orientation cross profile of the web, or varying the fiber orientation cross profile of the web without affecting the basis weight cross profile of the web, or varying both of the basis weight cross profile of the web and the fiber orientation cross profile of the web but with the variation of each such cross profile not affecting the other such cross profile; and further wherein the basis weight cross profile of the web is varied without affecting the fiber orientation cross profile of the web by adjusting the partial streams to each section for which the partial streams are adjusted in order to adjust the basis weight cross profile of the web, in a manner such that the total volume per unit of time of the combined stream supplied by each such section remains unchanged.

2. The method of claim 1, wherein the adjustment of partial streams to one section for adjusting the basis weight cross profile comprises increasing the volume per unit of time of one partial stream to the one section while decreasing the volume per unit of time of another partial stream to the one section.

3. The method of claim 1, wherein the fiber orientation cross profile of the web is varied without affecting the basis weight cross profile of the web by adjusting the volume per unit time of the combined stream to at least one of the sections without affecting the ratio of the volume per unit of time of the partial streams forming the combined stream to the at least one section.

4. The method of claim 3, wherein the volume per unit time of the partial streams to the at least one section are selectively all increased or all decreased to the respective extents for maintaining the ratio of the volumes per unit of time of the partial streams to the at least one section constant and thereby maintaining the basis weight cross profile constant.

5. The method of claim 1, wherein the fiber orientation cross profile of the web is varied without affecting the basis weight cross profile of the web by adjusting the volume per unit of time of the flow from at least one of the sections without affecting the volume per unit of time of the flow from at least some of the other sections and without affecting the density of the suspension in the flow from any of the sections including the at least one section.

* * * * *